US009217613B2

(12) United States Patent
Langner

(10) Patent No.: US 9,217,613 B2
(45) **Date of Patent: *Dec. 22, 2015**

(54) SYSTEMS AND METHODS FOR DISRUPTER RECOVERY

(71) Applicant: F. Richard Langner, Fountain Hills, AZ (US)

(72) Inventor: F. Richard Langner, Fountain Hills, AZ (US)

( * ) Notice: Subject to any disclaimer, the term of this patent is extended or adjusted under 35 U.S.C. 154(b) by 130 days.

This patent is subject to a terminal disclaimer.

(21) Appl. No.: 13/783,571

(22) Filed: Mar. 4, 2013

(65) Prior Publication Data

US 2014/0245878 A1 Sep. 4, 2014

Related U.S. Application Data

(63) Continuation of application No. 13/118,233, filed on May 27, 2011, now Pat. No. 8,413,570.

(60) Provisional application No. 61/396,526, filed on Jun. 1, 2010.

(51) Int. Cl.

| | |
|---|---|
| ***F42D 5/04*** | (2006.01) |
| ***F41A 25/00*** | (2006.01) |
| ***F41A 25/06*** | (2006.01) |
| ***F41A 21/48*** | (2006.01) |
| ***F41A 5/14*** | (2006.01) |
| ***F41A 25/02*** | (2006.01) |

(52) U.S. Cl.

CPC . *F41A 5/14* (2013.01); *F41A 21/48* (2013.01); *F41A 21/484* (2013.01); *F41A 21/487* (2013.01); *F41A 25/00* (2013.01); *F41A 25/02* (2013.01); *F41A 25/06* (2013.01); *F42D 5/04* (2013.01)

(58) Field of Classification Search

CPC ..... F42D 5/04; B64D 17/00; F41A 25/00; F41A 25/06; F41A 21/48; F41A 21/484; F41A 21/487

USPC ..... 86/50; 89/42.01, 42.02, 42.03, 43.01, 89/43.02, 44.01, 44.02, 14.3; 42/1.06

See application file for complete search history.

(56) References Cited

U.S. PATENT DOCUMENTS

| | | | | |
|---|---|---|---|---|
| 2,785,632 | A | 3/1957 | Clauser et al. | |
| 3,128,670 | A | 4/1964 | Blacker | |
| 4,932,308 | A * | 6/1990 | Arene et al. | 89/37.01 |
| 5,491,917 | A * | 2/1996 | Dilhan et al. | 42/1.06 |
| 6,295,911 | B1 | 10/2001 | Woodall et al. | |
| 6,490,957 | B1 * | 12/2002 | Alexander et al. | 86/50 |
| 6,578,464 | B2 | 6/2003 | Ebersole, Jr. | |
| 6,789,456 | B2 * | 9/2004 | DeRoos | F41A 25/06 188/136 |
| 6,889,594 | B2 | 5/2005 | Ebersole, Jr. | |
| 7,533,597 | B1 * | 5/2009 | Strohman | 86/50 |
| 8,307,941 | B2 | 11/2012 | Luchini et al. | |
| 8,413,570 | B2 * | 4/2013 | Langner | 89/42.01 |
| 8,915,004 | B1 * | 12/2014 | Langner | F42D 5/04 124/65 |

FOREIGN PATENT DOCUMENTS

| | | |
|---|---|---|
| GB | 1000272 | 8/1965 |
| GB | 1079098 | 8/1967 |
| WO | 89/04451 | 5/1989 |

* cited by examiner

*Primary Examiner* — James S Bergin

(74) *Attorney, Agent, or Firm* — Lawrence Letham; Letham Law Firm LLC

(57) ABSTRACT

A recovery system for a disrupter barrel. The recovery system limits the distance the disrupter travels as a result of a force or recoil that occurs upon firing the disrupter.

18 Claims, 3 Drawing Sheets

SYSTEMS AND METHODS FOR DISRUPTER RECOVERY

RELATED APPLICATIONS

This invention claims priority, under 35 U.S.C. §120, as a continuation of U.S. patent application Ser. No. 13/188,233 to F. Richard Langner filed on May 27, 2011, which claims priority under 35 U.S.C. §119(e) to U.S. Provisional Patent Application No. 61/396,526 to F. Richard Langner filed on Jun. 1, 2010, which application is incorporated by reference herein.

FIELD OF THE INVENTION

The present invention relates to percussion actuated non-electric (PAN) disrupters or dearmers, and more specifically, to the disrupter ejection and recover system for use with light weight disrupter barrels which are used for disabling and destroying IEDs.

BACKGROUND OF THE INVENTION

Percussion actuated non-electric (PAN) disrupters or dearmers are often used by military personnel, bomb squads, and other emergency service personnel in the destruction and disablement of improvised explosive devices (IEDs) and other bombs and/or ordnance. A typical PAN disrupter comprises a heavy duty 12-guage shotgun barrel which can be operated remotely through the use of a robot, for example, in order to facilitate firing of the device from a safe distance. The PAN disrupter is often engaged electrically or by a shock tube. Such a PAN disrupter uses specially designed 12-gauge shotgun ammunition in conjunction with various sighting methods which predominantly use a laser sight.

Typically, compact disrupter barrels, used for destroying IEDs, are unable to absorb the recoil created by the high energy cartridges used for this purpose. The energy generated causes the disrupter, if not restrained, to travelled in the opposite direction at a high velocity and for a long distance. In one test, a disrupter traveled approximately 70 yards. Obviously, this reaction is undesirable for safety reasons, collateral damage or surrounding objects and for the loss of the disrupter. In addition, the recoil may not allow the disrupter to be mounted to a light weight robot since the force generated by the recoil may cause significant damage to the robot when fired.

Therefore, a need exists to provide a device and method to overcome the above problems of the prior art.

SUMMARY

In accordance with one embodiment, an ejection and recover system for a disrupter barrel is disclosed. The ejection and recover system has a parachute. A housing having a channel formed there through is provided wherein the disrupter barrel is positioned in the channel. A tube is coupled to the housing for storing the parachute. A lanyard is coupled to the parachute and to the disrupter barrel.

In accordance with another embodiment of the present invention, an ejection and recover system for a disrupter barrel is disclosed. The ejection and recover system has a parachute. A lanyard is coupled to the parachute and to the disrupter barrel.

The features, functions, and advantages can be achieved independently in various embodiments of the disclosure or may be combined in yet another embodiment.

BRIEF DESCRIPTION OF THE DRAWING

Embodiments of the disclosure will become more fully understood from the detailed description and the accompanying drawings, wherein.

Common reference numerals are used throughout the drawings and detailed description to indicate like elements.

DETAILED DESCRIPTION

Figure 1:
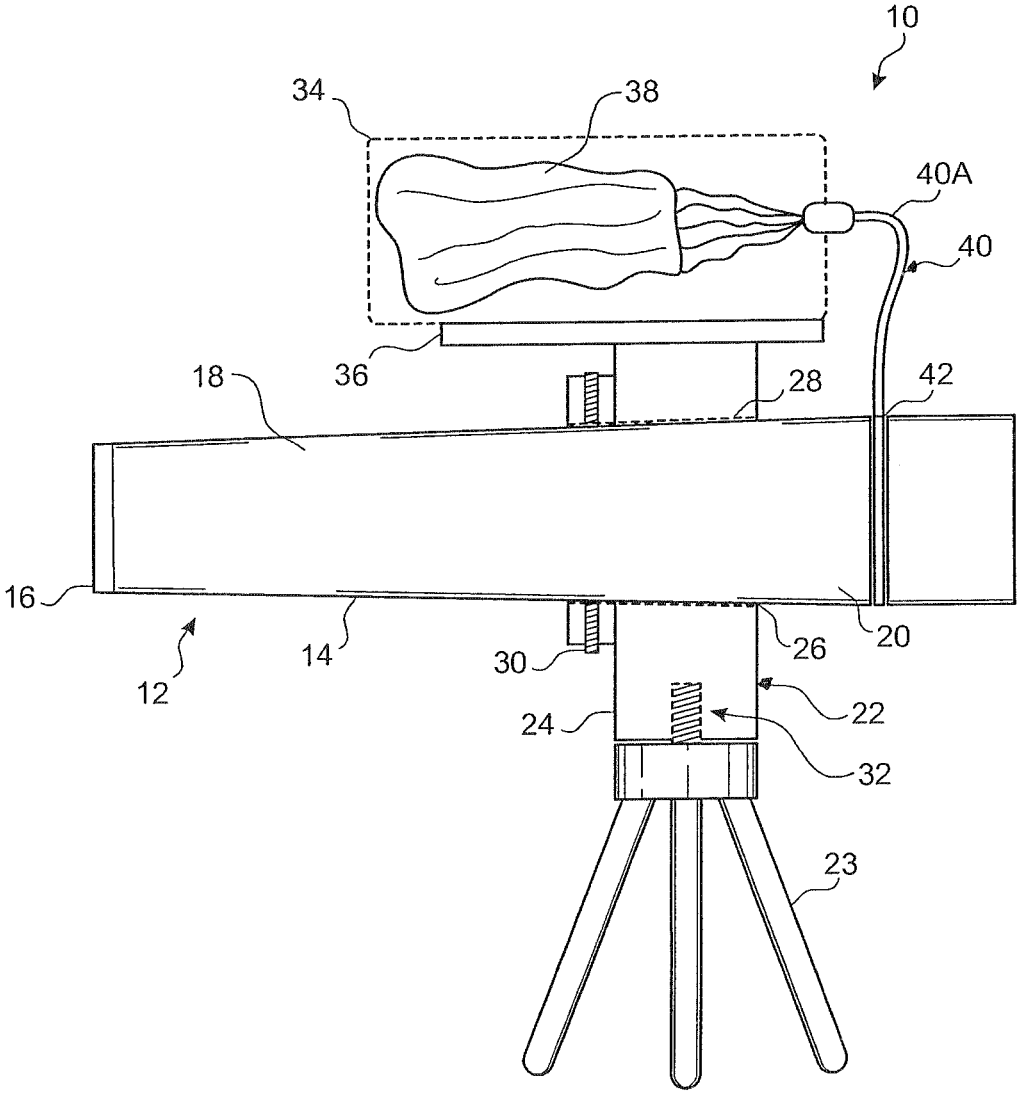
FIG. 1 is a side view of the disrupter ejection and recover system consistent with an embodiment of the present invention.
Figure 2A:
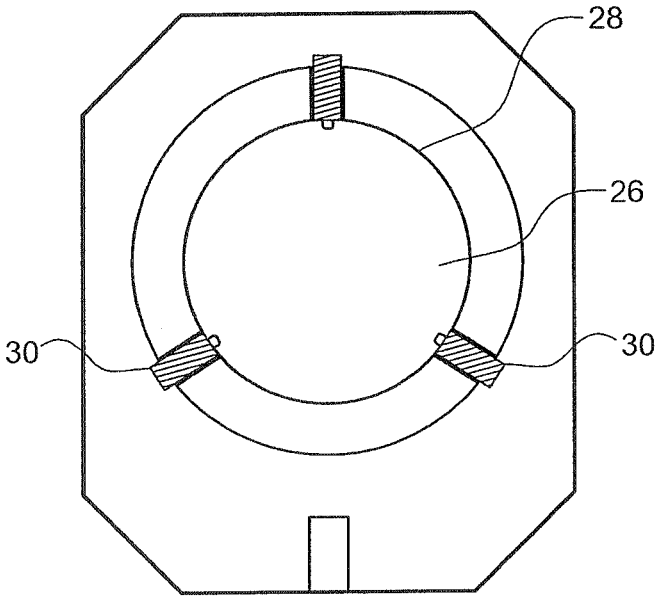
FIG. 2A is a front view of the disrupter barrel mount housing used in the system of FIG. 1.
Figure 2B:
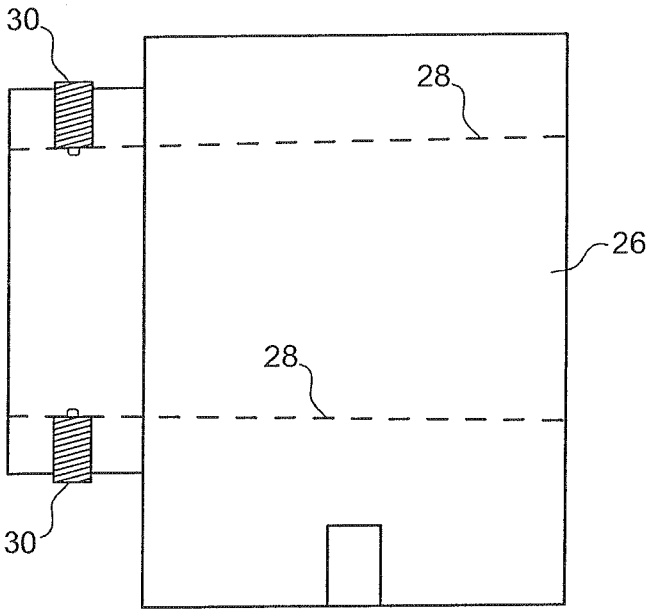
FIG. 2B is a side view of the disrupter barrel mount housing used in the system of FIG. 1.

Referring first to FIGS. 1-2, disrupter ejection and recover system 10 (hereinafter system 10, is shown. The system 10 may have a disrupter barrel 12. The disrupter barrel 12 may be comprised of a barrel section 14 having a muzzle end 16, a bore end 18, and a chamber 20. In accordance with one embodiment, the barrel section 14 may be a heavy-duty 12-guage shotgun barrel. The barrel section 14 may be formed of a carbon fiber wrapped titanium barrel. The above are given as examples and should not be seen in a limiting manner.

Figure 3:
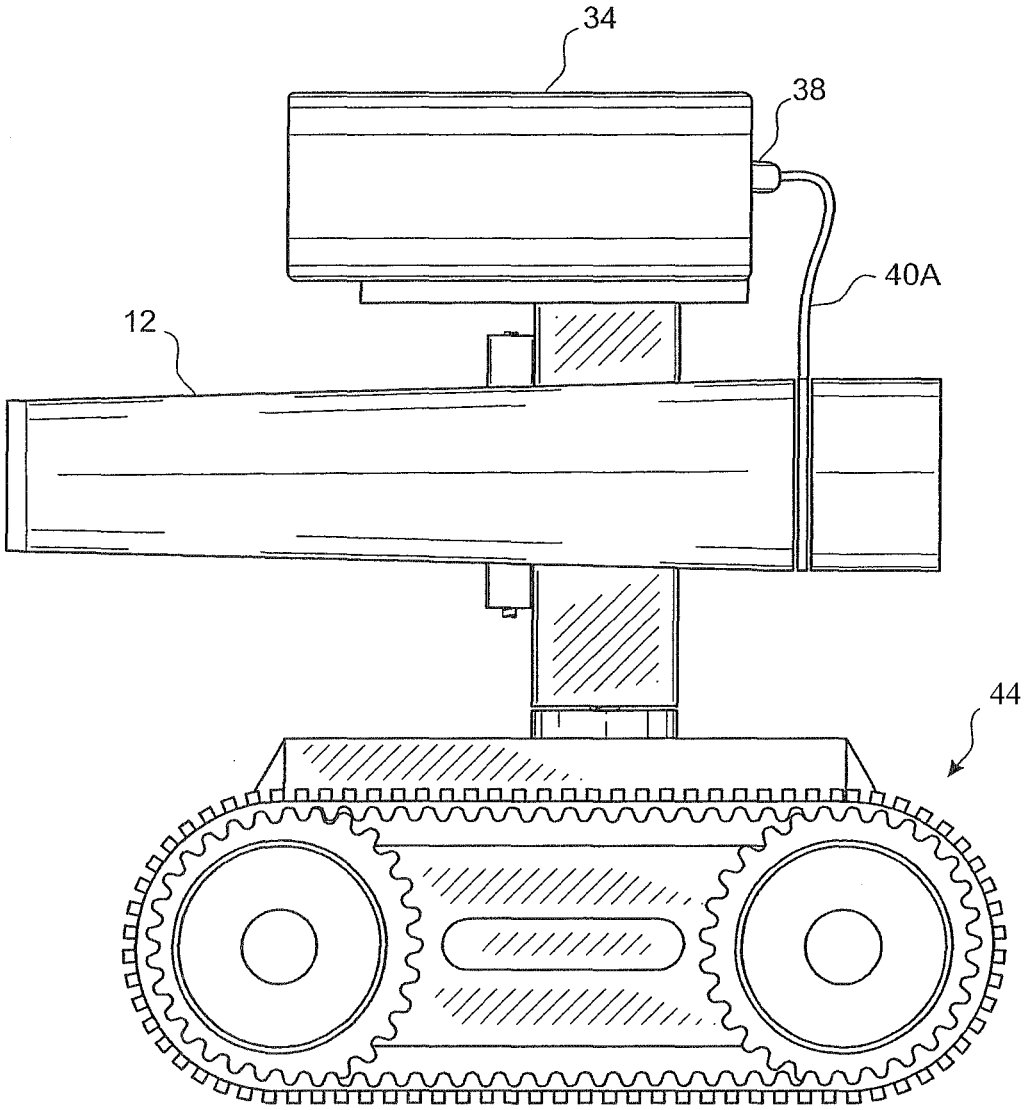
FIG. 3 is a side view of the disrupter ejection and recover system mounted on a robot.

A barrel mounting device 22 may be secured to the barrel section 14. The barrel mounting device 22 may be used to secure the disrupter barrel 12 to a tripod 23 as shown in FIG. 1 or to a robot device 44 as shown in FIG. 3. The barrel mounting device 22 may have a housing 24. A channel 26 may be formed through the housing 24. The channel 26 may generally be a horizontal channel formed through the housing 24. The barrel section 14 may be inserted through the channel 26. The channel 26 may have a coating layer 28 applied to an interior surface of the channel 26. The coating layer 28 may be a non-stick coating such as polytetrafluoroethylene (PTFE) more commonly known as Teflon®.

One or more securing devices 30 may be used to help hold the barrel section 14 within the housing 24 when desired. The securing devices 30 may be plunger mechanisms or the like. In general, the securing devices 30 may be adjustable tension devices. The securing devices 30 would typically be required when the system 10 is mounted on a robot 44 to ensure that the barrel section 14 does not loosen during travel to the target. The slight tension, used to retain the barrel section 14, does not affect the ejection of the barrel section 14.

A coupling mechanism 32 may be formed in the housing 24. The coupling mechanism 32 may be used to secure the system 10 to the tripod 23 as shown if FIG. 1 or to the robot device 44 as shown in FIG. 3. In general, the coupling mechanism 32 may be some type of threaded channel or the like.

A tube 34 may be coupled to the housing 24. In the embodiment shown in FIG. 1, a mounting rail 36 may be used to attach the tube 34 to the housing 24. The mounting rail 36 may be a standardized mounting platform such as the Picatinny Rail Accessory Mount or the like.

The tube 34 may be used to house a parachute 38. The parachute 38 may be coupled to the barrel section 14 in order to create a drag to limit the travel of the barrel section 14. A connection device 40 may be used to secure the parachute 38 to the barrel section 14. In general, the connection device 40 may be coupled to the parachute 38 and to the rear section of the barrel section 14 such as the breech area of the barrel section 14.

In the embodiment shown in FIG. 1, a groove 42 may be formed in the barrel section 14. The groove 42 may be formed in a rear section of the barrel section 14. The connection device 40 may be a lanyard 40A or the like. One end of the lanyard 40A may be secured within the groove 42. A second end of the lanyard 40A may be secured to the parachute 38. The groove 42 may be formed in the rear section of the barrel section 14 to insure that the lanyard 40A clears the barrel mounting device 22 as well as the tripod 24 or robot device 44 to which the disrupter barrel 12 is coupled.

In operation, the disrupter barrel 12 may be operated according to standard protocol, which may generally include being operated electrically or by a shock tube in order to permit firing of the device from a safe distance. The parachute 38 may be pulled out of the tube 34 when the disrupter barrel 12 is fired and ejected from the housing 24. The parachute 38 will begin to open as soon as it has been pulled clear of the housing 24 and will contain the travel of the disrupter barrel 12 within approximately 10 yards.

While embodiments of the disclosure have been described in terms of various specific embodiments, those skilled in the art will recognize that the embodiments of the disclosure can be practiced with modifications within the spirit and scope of the claims.

What is claimed is:

1. A disrupter for disabling a provided target, the disrupter comprising:

a barrel for launching a provided projectile toward the target to disable the target;

a housing having a channel formed through the housing, an axis along the channel, the channel receives the barrel to position the barrel toward the target along the axis prior to launching the projectile;

an aerodynamic brake coupled to the barrel; and a coating on at least a portion of an inner surface of the channel; wherein the barrel contacts the coating while positioned in the channel;

responsive to launching the projectile, a force of recoil ejects the barrel from the channel and moves the barrel away from the housing; and the aerodynamic brake limits travel of the barrel away from the housing.

2. The disrupter of claim 1 further comprising a securing device that exerts a force on the barrel to secure the barrel in the channel prior to launching the projectile wherein the force of recoil overcomes the force exerted by the securing device to permit movement of the barrel out of the channel.

3. The disrupter of claim 2 wherein the securing device is positioned at least partially in the channel.

4. The disrupter of claim 1 further comprising a lanyard wherein:

the lanyard is coupled to the aerodynamic brake and to the barrel; and responsive to the movement of the barrel out of the channel, the lanyard deploys the aerodynamic brake to limit travel of the barrel.

5. The disrupter of claim 1 further comprising a receptacle wherein the aerodynamic brake is positioned in the receptacle prior to launching the projectile.

6. The disrupter of claim 1 wherein the aerodynamic brake comprises a parachute.

7. The disrupter of claim 6 further comprising a lanyard wherein:

the lanyard couples the parachute to the barrel; and responsive to the movement of the barrel out of the channel, the lanyard extends to deploy the parachute to limit travel of the barrel.

8. The disrupter of claim 6 further comprising a tube wherein the parachute is positioned in the tube prior to launching the projectile.

9. The disrupter of claim 1 wherein the coating comprises a non-stick material.

10. The disrupter of claim 1 wherein the housing further comprises a coupling mechanism for coupling the housing to a provided support.

11. A disrupter for disabling a provided target, the disrupter comprising:

a barrel for launching a provided projectile toward the target to disable the target;

a housing having a channel formed through the housing, an axis along the channel, the barrel positioned in the channel along the axis prior to launching the projectile, the housing positions the barrel toward the target;

a coating on at least a portion of an inner surface of the channel; wherein the barrel contacts the coating while positioned in the channel; and responsive to a force of recoil from launching the projectile, the coating facilitates ejecting the barrel out of the channel and movement of the barrel away from the housing.

12. The disrupter of claim 1 further comprising a securing device that exerts a force on the barrel to secure the barrel in the channel prior to launching the projectile wherein the force of recoil overcomes the force exerted by the securing device to permit movement of the barrel out of the channel.

13. The disrupter of claim 12 wherein the securing device is positioned at least partially in the channel.

14. The disrupter of claim 13 further comprising a receptacle wherein the aerodynamic brake is positioned in the receptacle prior to launching the projectile.

15. The disrupter of claim 14 further comprising a lanyard wherein:

the lanyard couples the parachute to the barrel; and responsive to the movement of the barrel out of the channel, the lanyard extends to deploy the parachute to limit travel of the barrel.

16. The disrupter of claim 13 wherein the aerodynamic brake comprises a parachute.

17. The disrupter of claim 11 further comprising a lanyard and an aerodynamic break, wherein:

the lanyard is coupled to the aerodynamic brake and to the barrel; and responsive to the movement of the barrel out of the channel, the lanyard deploys the aerodynamic brake to limit travel of the barrel.

18. The disrupter of claim 11 wherein the coating comprises a non-stick material.

* * * * *